US011622601B2

(12) United States Patent
Piacentini

(10) Patent No.: US 11,622,601 B2
(45) Date of Patent: Apr. 11, 2023

(54) FOOTWEAR WITH FLEXIBLE CAGE AND WEDGE

(71) Applicant: Reebok International Limited, Altrincham (GB)

(72) Inventor: Thomas Piacentini, Waltham, MA (US)

(73) Assignee: REEBOK INTERNATIONAL LIMITED, Altrincham (GB)

( * ) Notice: Subject to any disclaimer, the term of this patent is extended or adjusted under 35 U.S.C. 154(b) by 157 days.

(21) Appl. No.: 16/556,953

(22) Filed: Aug. 30, 2019

(65) Prior Publication Data

US 2021/0059351 A1 Mar. 4, 2021

(51) Int. Cl.

| | |
|---|---|
| ***A43B 7/14*** | (2022.01) |
| ***A43B 7/24*** | (2006.01) |
| ***A43B 13/18*** | (2006.01) |
| ***A43B 23/08*** | (2006.01) |
| ***A43B 13/14*** | (2006.01) |
| ***A43B 13/20*** | (2006.01) |
| ***A43B 13/12*** | (2006.01) |
| ***A43B 7/144*** | (2022.01) |
| ***A43B 23/17*** | (2006.01) |

(52) U.S. Cl.

CPC ..... *A43B 13/141* (2013.01); *A43B 7/144* (2013.01); *A43B 7/24* (2013.01); *A43B 13/12* (2013.01); *A43B 13/188* (2013.01); *A43B 13/20* (2013.01); *A43B 23/088* (2013.01); *A43B 23/17* (2013.01)

(58) Field of Classification Search

CPC .. A43B 7/144; A43B 7/16; A43B 7/24; A43B 13/148; A43B 13/188; A43B 23/088; A43B 23/10; A43B 23/105; A43B 23/16; A43B 23/17

See application file for complete search history.

(56) References Cited

U.S. PATENT DOCUMENTS

| | | | | | |
|---|---|---|---|---|---|
| 2,616,190 | A * | 11/1952 | Darby | A43B 7/142 | 36/144 |
| 4,484,397 | A * | 11/1984 | Curley, Jr. | A43B 23/17 | 36/132 |
| 4,769,926 | A * | 9/1988 | Meyers | A43B 5/00 | 36/154 |
| 4,882,856 | A * | 11/1989 | Glancy | A43B 21/32 | 36/43 |
| 5,279,051 | A * | 1/1994 | Whatley | A43B 13/181 | 36/114 |
| 6,944,973 | B2 * | 9/2005 | Goodwin | A43B 13/12 | 36/29 |

(Continued)

*Primary Examiner* — Sharon M Prange

(74) *Attorney, Agent, or Firm* — Sterne, Kessler, Goldstein & Fox P.L.L.C.

(57) ABSTRACT

An article of footwear includes an upper, a midsole, and an outsole, where the midsole is located between the outsole and the upper. A wedge is located between the outsole and the midsole and is preferably made of a material that is less compressible than the midsole. A flexible cage is located on the exterior surfaces of the upper and midsole. In embodiments, the flexible cage is designed to limit the outward expansion of the midsole when the midsole is compressed under load, and thus effectively stiffen the midsole. The total compression of the midsole of the article of footwear is based, at least in part, on a desired orientation of the ankle, knee, and hip joints of a user.

18 Claims, 7 Drawing Sheets

(56) References Cited

U.S. PATENT DOCUMENTS

| | | | | |
|---|---|---|---|---|
| 8,327,560 | B2 * | 12/2012 | Berend | A43B 7/1425 36/92 |
| 8,677,656 | B2 * | 3/2014 | Nishiwaki | A43B 7/20 36/69 |
| 8,695,236 | B2 * | 4/2014 | Nishiwaki | A43B 13/125 36/142 |
| 10,588,378 | B2 * | 3/2020 | Groeneweg | A43B 23/227 |
| 2008/0244930 | A1 * | 10/2008 | Rivas | A43B 7/24 36/88 |
| 2012/0260527 | A1 * | 10/2012 | Noh | A43B 7/223 36/85 |
| 2016/0150854 | A1 * | 6/2016 | Hockerson | A43B 3/0005 36/28 |

* cited by examiner

FOOTWEAR WITH FLEXIBLE CAGE AND WEDGE

FIELD OF THE INVENTION

The present disclosure relates to an article of footwear having a flexible cage and wedge structure.

BACKGROUND OF THE INVENTION

Achieving an optimal balance between stability and comfort is an important aspect of the design of any article of footwear. Stability requires providing the necessary support to the foot when the foot impacts the ground. Comfort requires sufficient cushioning in order to absorb and dissipate the force of these impacts. Improving stability typically requires more rigid footwear, while increasing comfort typically requires softer or more cushioned footwear. Accordingly, an article of footwear must strike a balance between stability and comfort based, at least in part, on the nature of the possible activities that the footwear is designed for. An important aspect of stability is ensuring the optimal alignment of various elements of a user's anatomy during athletic activities. For example, the ankle, knee, and hip joints function more effectively and with less wear when these joints are moved through a specific angular range of motion.

BRIEF SUMMARY OF THE INVENTION

In embodiments, an article of footwear according to the present disclosure includes an upper, a midsole coupled to the upper, an outsole coupled to the midsole, and a wedge disposed between the outsole and the midsole. A flexible cage is located on an exterior surface of the midsole, wherein the flexible cage portion comprises a plurality of apertures. The flexible cage portion is fixedly attached at a first portion of the midsole above the wedge and at a second portion of the midsole above the first portion.

In further embodiments an article of footwear includes an upper, a midsole coupled to the upper, an outsole coupled to the midsole, and a wedge portion disposed between the midsole and the outsole. The wedge portion is configured to limit the total compression of the midsole when the article of footwear is supporting the load of a user. A flexible cage is disposed on an exterior surface of the midsole such that the flexible cage portion is at least partially attached to the midsole, wherein the flexible cage is configured to limit the compression of the midsole by restricting the distance that the midsole may expand beyond an unloaded exterior surface of the midsole.

BRIEF DESCRIPTION OF THE DRAWINGS/FIGURES

The accompanying drawings, which are incorporated herein and form part of the specification, illustrate aspects of the present invention and, together with the description, further serve to explain the principles of the invention and to enable a person skilled in the relevant art to make and use the invention.

DETAILED DESCRIPTION OF THE INVENTION

The present invention(s) will now be described in detail with reference to embodiments thereof as illustrated in the accompanying drawings. References to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiment whether or not explicitly described.

Achieving an optimal balance between stability and comfort is an important aspect of designing a new article of footwear, particularly when the article of footwear is intended for use in athletic activities. Stability typically requires a more rigid article of footwear, while comfort requires a softer or more cushioned article of footwear. Stability is particularly important in articles of footwear used in athletic activities because it is important to ensure that a user's foot is oriented properly to absorb impacts. Proper foot orientation is necessary to maximize the efficiency of and minimize the wear on a user's muscles and joints, particularly the ankle, knee, and hip joints and related musculature.

In embodiments, an article of footwear according to the present disclosure includes an upper, a midsole coupled to the upper, an outsole coupled to the midsole, and a wedge disposed between the outsole and the midsole. A flexible cage is located on an exterior surface of the midsole, wherein the flexible cage portion comprises a plurality of apertures. The flexible cage portion is fixedly attached at a first portion of the midsole above the wedge and at a second portion of the midsole above the first portion. Embodiments of the article of footwear may have several advantages, including, for example, the ability to optimize the orientation of the foot upon impact through the design of the wedge disposed between the outsole and the ability to limit the compression of the midsole with the flexible cage, and thus increase the stability of the article of footwear.

As shown in FIGS. 1-3 and 6, an article of footwear 1 includes an upper 10 with an upper opening 12 that is configured to receive a foot of a user. Upper 10 also includes laces 14 that may be used to adjust the fit of upper 10 around the foot of a user. Upper 10 may be made of any suitable material. In embodiments, upper 10 is made of a lightweight, flexible material, such as, for example, fabric mesh, woven fabric, knitted material, leather, or a solid fabric.

Figure 4:
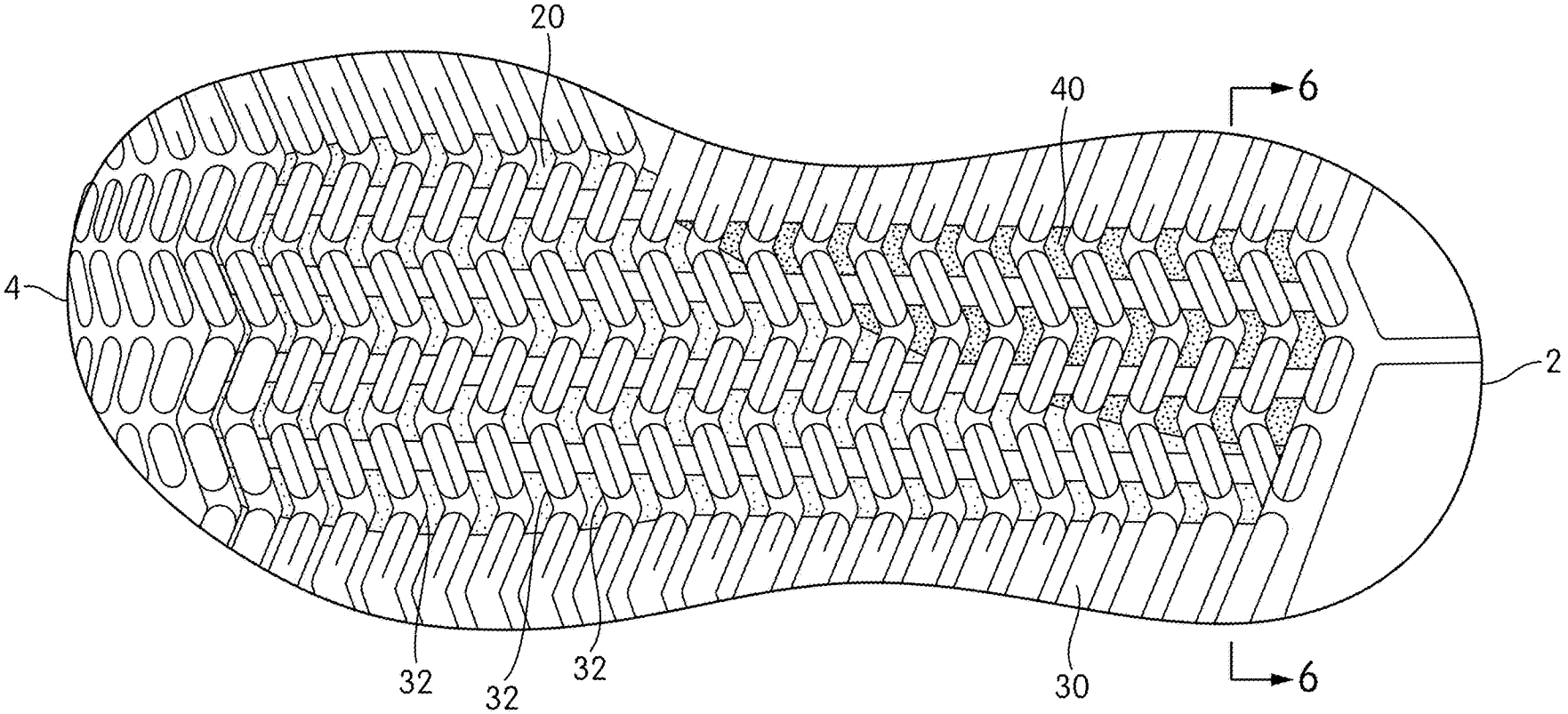
FIG. 4 is a bottom view of an article of footwear according to embodiments.

Upper 10 is connected to a midsole 20, which is located between upper 10 and a ground plane 3. Midsole 20 (described below) is connected to an outsole 30, which is located between midsole 20 and ground plane 3. Outsole 30 is the portion of article of footwear 1 that is in contact with the ground when article of footwear 1 is in use. As best shown in FIG. 4, outsole 30 may include various features to enhance the traction of article of footwear 1, such as treads 32. Upper 10, midsole 20, and outsole 30 may be connected together through any suitable technique known in the art, including, for example, adhesives, plastic welding, or stitching.

Figure 2:
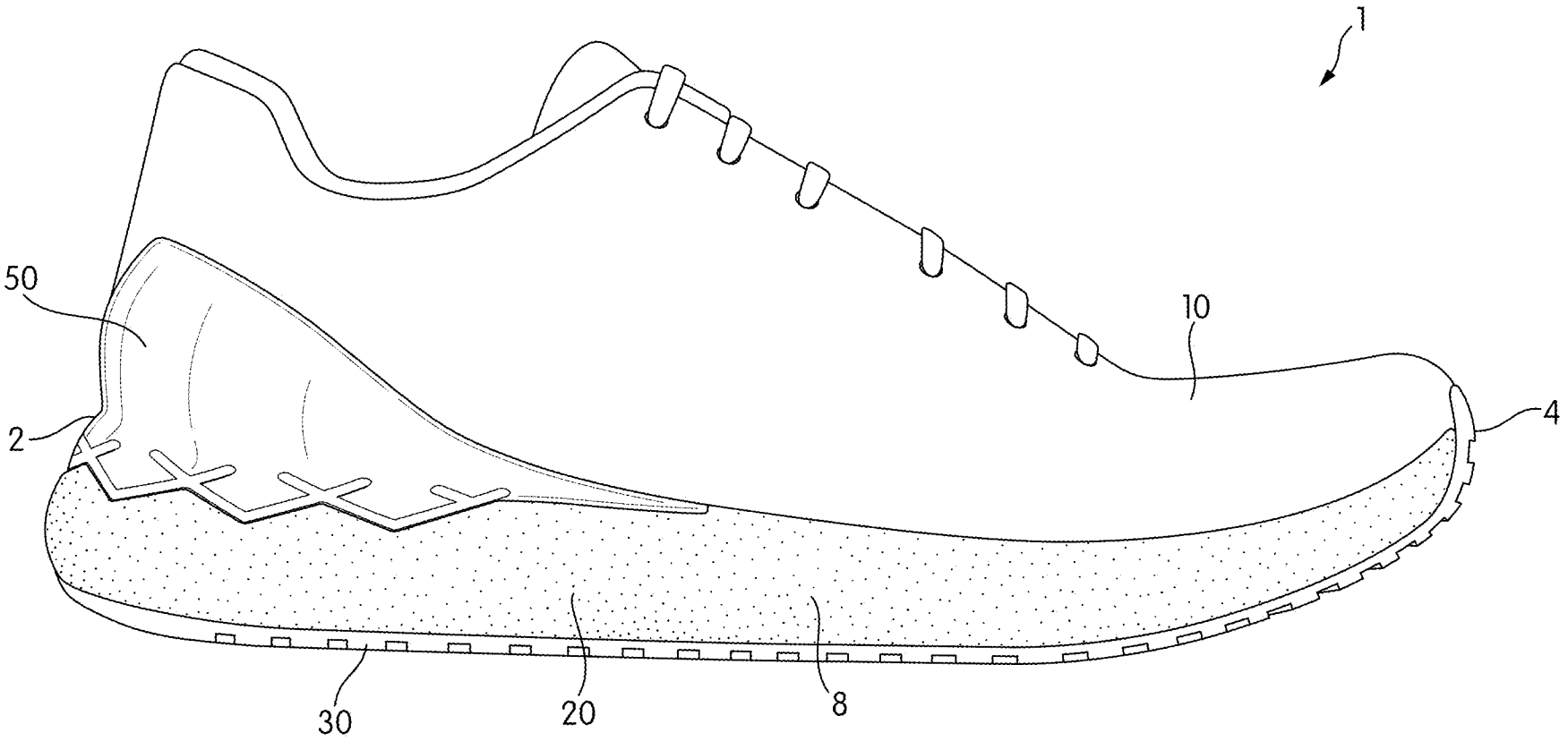
FIG. 2 is a side view of an article of footwear according to embodiments.

Midsole 20 is configured to cushion impacts transmitted from outsole 30 when article of footwear 1 is in use. Midsole 20 is also configured to provide stability to the foot of a user. When loaded during an impact, midsole 20 is configured to compress and thus absorb and dissipate the force of the impact. The amount of compression of midsole 20 can be configured based on the balance of stability and comfort desired. Typically, less compression would result in more stability, while more compression results in more comfort. As best shown in FIG. 2, in embodiments midsole 20 may extend along the entire length of article of footwear 1, between outsole 30 and upper 10. However, midsole 20 does not need to extend the entire length of article of footwear 1. Midsole 20 may be made of any suitable lightweight, cushioning material. For example, midsole 20 may be made of polyurethane, elastomers including thermoplastic elastomers, eTPU, ethylvinyl acetate ("EVA"), or combinations of these materials.

Figure 3:
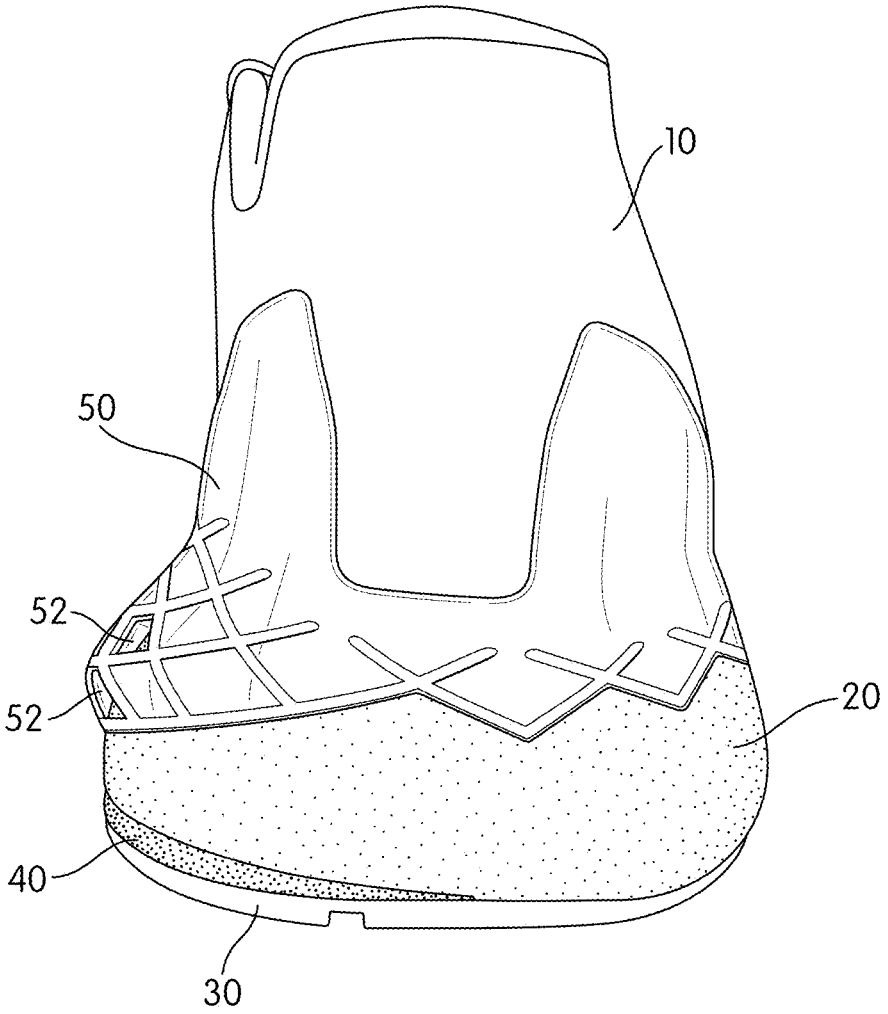
FIG. 3 is a rear view of an article of footwear according to embodiments.
Figure 6:
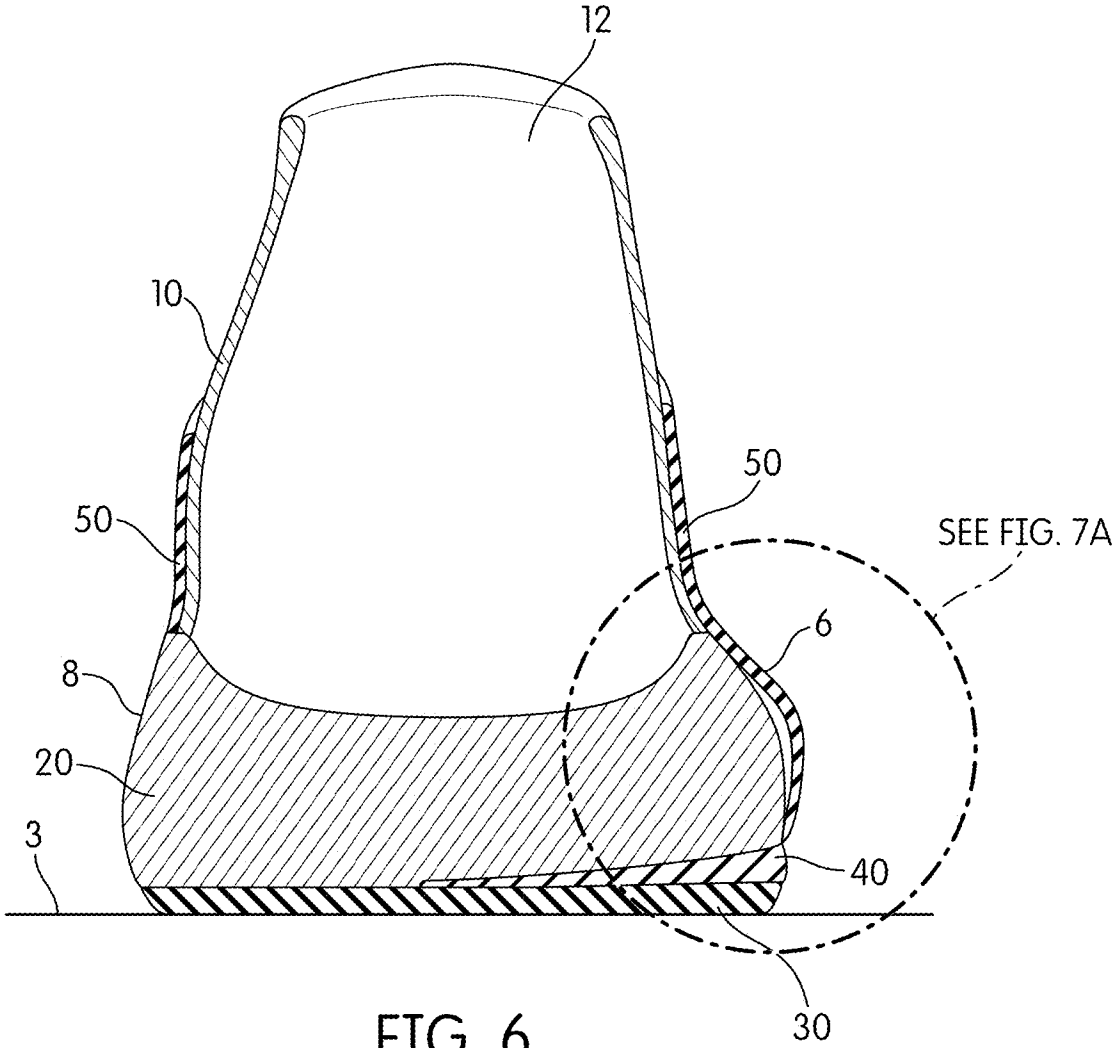
FIG. 6 is a cross section view of an article of footwear according to embodiments.

In embodiments, a wedge 40 may be located between midsole 20 and outsole 30, as best shown in FIGS. 3-4 and 6. Wedge 40 is configured to provide additional stability to at least a portion of midsole 20. In embodiments, wedge 40 is made from a material that is stiffer, or less compressible, than the material of midsole 20. Thus, the portion of article of footwear 1 that includes wedge 40 between midsole 20 and outsole 30 will have less total compression during loading than article of footwear 1 that only includes midsole 20. Thus, including wedge 40 may result in an article of footwear 1 with more stability than an equivalent article of footwear 1 that does not include wedge 40. This may be desirable in embodiments, for example, because it allows certain portions of article of footwear 1 to provide greater stability and support, while maintaining an increased amount of cushioning in other areas of article of footwear 1. This occurs because of the reduced total compression created by wedge 40 in the areas of article of footwear 1 that include wedge 40. In some embodiments, it may be desirable to provide more stability through the inclusion of wedge 40 under certain areas of the foot, such as, for example under the heel of article of footwear 1. The specific characteristics of wedge 40, in particular thickness and compressibility, may be modified to suit any particular set of design parameters by varying the material choice and shape of wedge 40.

Wedge 40 may extend over any desired portion of article of footwear 1. The precise configuration of wedge 40 may be tailored in different embodiments of article of footwear 1 to provide the desired change in compression, and thus stability, where needed. For example, as shown in FIG. 4, wedge 40 may extend from a heel 2 of article of footwear 1 longitudinally forward toward a toe 4 along a medial side 6 of article of footwear 1. In embodiments as shown in FIG. 4, wedge 40 may extend longitudinally along medial side 6 from heel 2 until it is forward of a midpoint of article of footwear 1. As shown in FIG. 4 and FIG. 6, which is a cross section of article of footwear 1, wedge 40 may extend laterally from medial side 6 towards a lateral side 8 of article of footwear 1. In FIG. 4, for example, wedge 40 extends more than halfway to lateral side 8 near heel 2, and then tapers towards medial side 6 as it extends forward towards toe 4. In this manner, wedge 40 may be thickest at a side of the sole (e.g., medial side 6) and have a reduced thickness at or near a center of the sole. In some of these embodiments, wedge 40 may have a maximum thickness located at medial side 6 of less than about 6 mm. In some embodiments, wedge 40 may have a maximum thickness in the range of about 2 mm to about 6 mm. For example, wedge 40 may have a maximum thickness of 2 mm, 4 mm, or 6 mm. In some embodiments, a maximum thickness of 4 mm of wedge 40 may provide optimal stability and performance. In embodiments, as shown in FIG. 4, wedge 40 may be confined to the medial half of article of footwear 1. Thus, in embodiments such as the one shown in FIGS. 4 and 6, article of footwear 1 would be less compressible, and thus provide greater support, in a region extending from heel 2 towards toe 4 along medial side 6 of article of footwear 1.

Wedge 40 may be made of any suitable material, including, for example, polyurethane, elastomers including thermoplastic elastomers, EVA, or combinations of these materials. In embodiments, wedge 40 may be made of a material such as an EVA foam when midsole 20 is made of a thermoplastic elastomer. The compressibility of wedge 40 may be varied as desired to increase or decrease the relative change in stability provided by the inclusion of wedge 40 in the desired portion of article of footwear 1. Wedge 40 may be connected to midsole 20 and outsole 30 in any suitable manner, such as through adhesives, welding, or stitching.

Embodiments of wedge 40 as shown in FIG. 4 may be configured to provide additional support to article of footwear 1 near heel 2 and medial side 6. This may be desirable, for example, to provide additional support to the heel of a user, and also to prevent overpronation, or rotation towards the medial or inner side, of the foot of a user as it impacts with the ground.

Embodiments of wedge 40 may also be designed to create an optimal orientation of the foot as it impacts with the ground. For example, embodiments of wedge 40 as discussed above and as shown in FIG. 4 increase the stability of the heel and medial side of article of footwear 1. This stability, in turn, tends to rotate the foot of a user further towards the lateral or outward side, as well as preventing the user from rolling too far back on their heel. Thus, a desirable orientation of the foot, and in turn the ankle joint, can be achieved by selectively configuring wedge 40. Because of the interconnected nature of the human body, the orientation of the foot upon impact with the ground will also affect the orientation of the knee and hip joints. For example, some embodiments of wedge 40 may be designed to ensure that the knee is oriented in the same direction as the toes. For example, as discussed above some embodiments of wedge 40 may be thickest at a side of the sole (e.g., medial side 6) and have a reduced thickness at or near a center of the sole. In some of these embodiments, wedge 40 may have a maximum thickness in the range of about 2 mm to about 6 mm. These embodiments may provide an optimized orientation of the knees relative to the toes. In some embodiments, a maximum thickness of 4 mm of wedge 40 may provide optimal orientation of the foot, ankle, knee, and hip.

Figure 1:
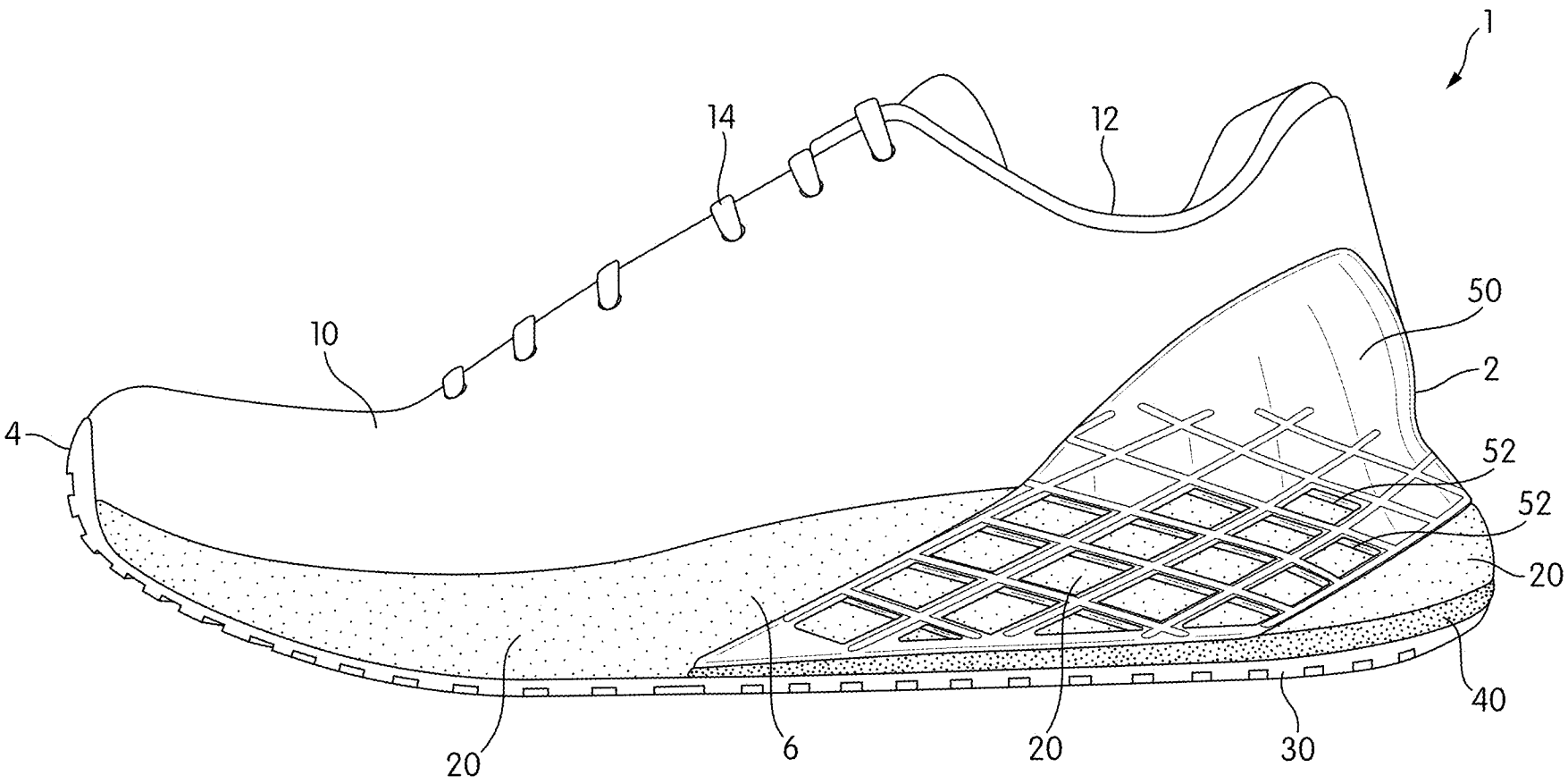
FIG. 1 is a side view of an article of footwear according to embodiments.
Figure 5:
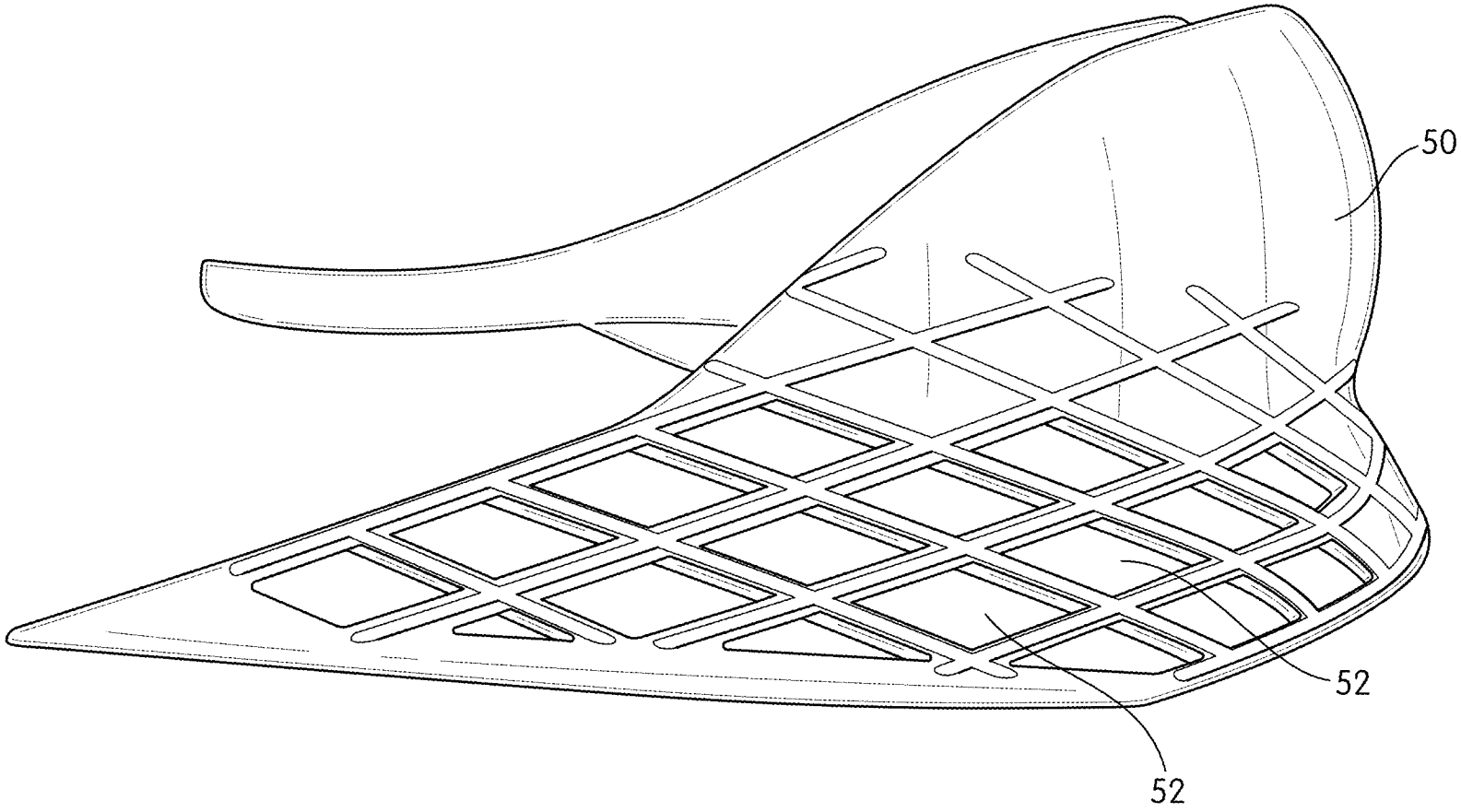
FIG. 5 is a detail view of elements of an article of footwear according to embodiments.
Figure 7B:
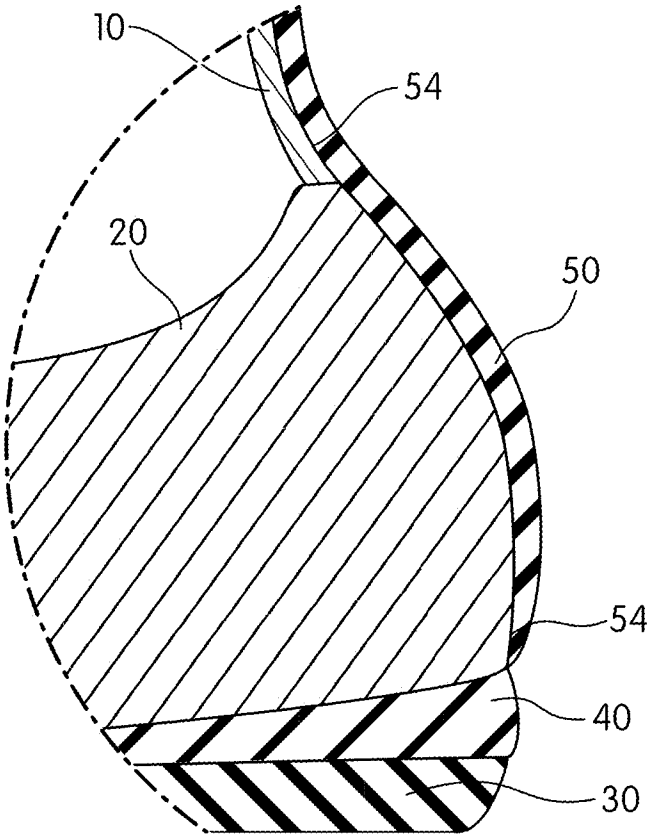
FIG. 7B is a detail view of FIG. 6 with the article of footwear in a loaded condition.
Figure 7A:
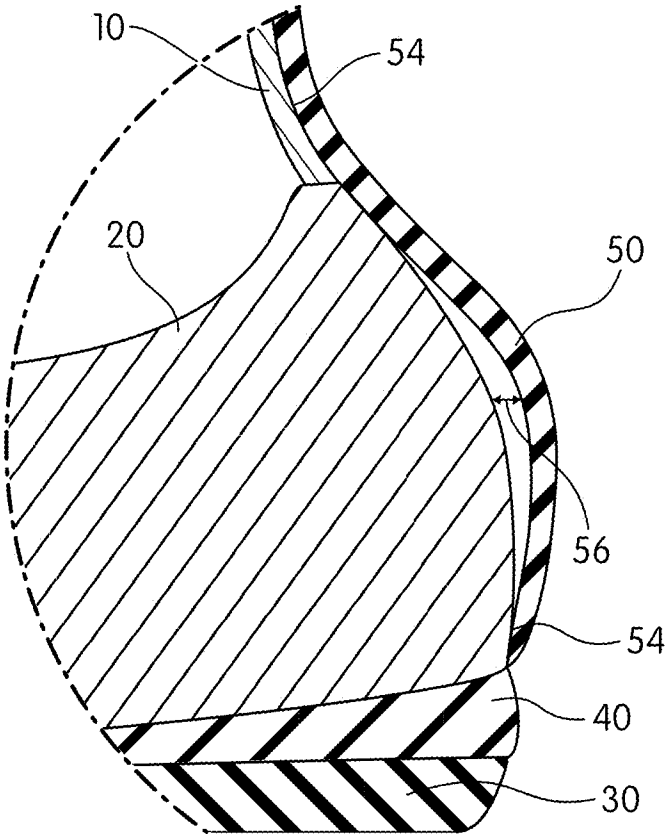
FIG. 7A is a detail view of FIG. 6.

As shown in FIGS. 1 and 5, embodiments of article of footwear 1 may include a flexible cage 50 located on an exterior surface of one or more of upper 10, midsole 20, and outsole 30. Flexible cage 50 may be made of any suitable material. In embodiments, flexible cage 50 is made of a semi-rigid plastic or rubber material. For example, flexible cage 50 could be made from TPU, TPR, Peba (Polyether block amide), or EVA materials, or any combination of these materials. Flexible cage 50 is configured to limit the outward expansion of midsole 20 when article of footwear 1 experiences a load. The materials typically used for midsole 20 will expand horizontally outwards, i.e. parallel to ground plane 3, when they experience a vertical loading, such as the loading during a step by a user. As best seen in FIG. 7A, which shows a detail view of the lower-right portion of the cross section of FIG. 6, embodiments of flexible cage 50 may be attached at attachment regions 54 to article of footwear 1 such that there is a gap 56 between a portion of the outer surface of midsole 20 and the inner surface of flexible cage 50. For example, as shown in FIGS. 7A-7B, attachment regions 54 may be located along the upper surface of midsole 20 and near the lower surface of midsole 20, just above the division between midsole 20 and wedge 40. In embodiments, flexible cage 50 is not attached to midsole 20 between attachment regions 54.

FIG. 7B shows the same detail view of FIG. 7A when article of footwear 1 is experiencing a load, such as during a step by a user. As shown, there is no gap 56 between flexible cage 50 and midsole 20 in FIG. 7B because midsole 20 has expanded outwards in response to being compressed by the load. In embodiments of article of footwear 1 without flexible cage 50, midsole 20 may expand outwards in response to being compressively loaded to whatever extent the material properties of midsole 20 dictated given the compressive loading conditions. However, in embodiments of article of footwear 1 that include flexible cage 50, the outwards expansion of midsole 20 is limited by flexible cage 50.

In embodiments of article of footwear 1 without a flexible cage 50, midsole 20 may be designed with sufficient stiffness such that midsole 20 does not "bottom out" under compressive loading, which is to say that midsole 20 becomes so thin due to outwards expansion that it no longer provides sufficient cushioning. This limits the cushioning effect that can be created by midsole 20. Embodiments with flexible cage 50 may provide several advantages over embodiments without flexible cage 50, including, for example, the ability to design midsole 20 with less stiffness because flexible cage 50 will limit the outward expansion of midsole 20, as shown in FIG. 7B and as discussed in more detail below.

Limiting the ability of midsole 20 to expand outwards will result in midsole 20 effectively becoming much less compressible, and thus stiffer, than midsole 20 would otherwise be. Thus, midsole 20 may be designed with less stiffness, and thus provide more cushioning upon the initial impact with the ground. As the compressive loading increases, for example as the user places their full weight on article of footwear 1, midsole 20 will expand outwards until it is stopped by flexible cage 50. This has the effect of increasing the compressive stiffness of midsole 20 after a certain amount of loading has been achieved. Such an effect is desirable because it provides an enhanced initial cushioning, before midsole 20 has expanded outwards to flexible cage 50, but then provides greater stability when a higher load is applied by limiting the outwards expansion of midsole 20, which is when stability is most necessary because of the increased stress on the various portions of the user's anatomy caused by the higher loading. The specific loading required to make midsole 20 reach flexible cage 50, represented by gap 56, may be designed to any specific point. For example, gap 56 may be smaller, and thus flexible cage 50 will restrict the expansion of midsole 20 sooner, in embodiments of article of footwear 1 designed for lower loads, such as those articles of footwear 1 designed for children.

In embodiments, flexible cage 50 may extend from medial side 6 around heel 2 to lateral side 8 of article of footwear 1, as shown in FIGS. 1-2. FIG. 5 shows an example of embodiments of flexible cage 50 separated from article of footwear 1. As shown in FIG. 5, flexible cage 50 may extend upwards such that it overlaps with upper 10. Flexible cage 50 may be connected to article of footwear 1 at attachment regions 54, which may be located near the top and bottom of flexible cage 50 on medial side 6, as shown in FIGS. 7A-7B. On lateral side 8, flexible cage 50 may be connected to upper 10. Flexible cage 50 may be connected to article of footwear 1 through any suitable technique, such as through adhesive coupling.

As shown in FIGS. 1 and 5, for example, embodiments of flexible cage 50 may include a plurality of apertures 52. Apertures 52 may be formed in any desired shape, such as the diamond shape shown. The exterior surface of midsole 20 is visible through apertures 52, as shown in FIG. 1, for example. Apertures 52 may also be configured to allow midsole 20 to expand outwardly after midsole 20 has contacted the inner surface of flexible cage 50. Apertures 52 may also be designed to enhance the aesthetic appearance of article of footwear 1. In embodiments, a portion of midsole 20 may expand through apertures 52 during loading.

In embodiments, article of footwear 1 may include both wedge 40 and flexible cage 50. In addition to the advantages discussed above, these elements in combination may provide further benefits to article of footwear 1. For example, the combination of wedge 40 and flexible cage 50 may enable wedge 40 to be made thinner and/or less stiff because flexible cage 50 effectively increases the stiffness of a portion of midsole 20, as discussed above. Further, as discussed above, the progressive nature of the stiffening provided by flexible cage 50 means that wedge 40 can be designed for lower loading conditions, and thus also be made thinner, because flexible cage 50 acts to stiffen midsole 20 at higher loads.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear, comprising:

an upper;

a midsole coupled to the upper;

an outsole coupled to the midsole;

a wedge disposed between the outsole and the midsole; and a flexible cage disposed on an exterior surface of at least one of the upper, the midsole, the wedge, and the outsole, wherein the flexible cage portion comprises a plurality of apertures, and wherein the flexible cage is fixedly attached to the midsole at a first portion of the midsole above the wedge and at a second portion of the midsole above the first portion, wherein the flexible cage is not attached to a portion of the midsole that is between the first portion and the second portion such that a space is formed between an outer surface of the midsole and the flexible cage between the first portion and the second portion, and wherein the flexible cage is configured to limit the compression of the midsole by restricting the distance that an exterior surface of the midsole may expand horizontally into the space during vertical loading of the midsole.

2. The article of footwear of claim 1, wherein the wedge is disposed on a medial side of the article of footwear.

3. The article of footwear of claim 2, wherein the wedge is further disposed below a heel portion of the article of footwear.

4. The article of footwear of claim 1, wherein the wedge is solely disposed on a medial portion of the article of footwear.

5. The article of footwear of claim 1, wherein the flexible cage is disposed on a medial side of the article of footwear.

6. The article of footwear of claim 1, wherein the wedge comprises a material that has a higher compressive strength than that of a material of the midsole.

7. The article of footwear of claim 6, wherein the wedge is configured to reduce a total compression of the midsole and the wedge under a load.

8. The article of footwear of claim 6, wherein the combination of the wedge and the flexible cage are configured to reduce the total compression of the midsole and the wedge such that a desired total compression is achieved under load, and wherein the desired total compression is based in part on achieving a predetermined hip, knee, and ankle orientation of a user.

9. An article of footwear, comprising:

an upper;

a midsole coupled to the upper;

a wedge portion disposed between the midsole and an outsole and connected to the midsole that is configured to limit the total compression of the midsole and the wedge when the article of footwear is supporting the load of a user; and a flexible cage disposed on an exterior surface of the midsole such that the flexible cage portion is attached to the midsole at a first portion of the midsole and a second portion of the midsole, wherein a space is formed between an outer surface of the midsole and the flexible cage between the first portion and the second portion, wherein the flexible cage is configured to limit the compression of the midsole by restricting the distance that an exterior surface of the midsole may expand horizontally from an unloaded position of the exterior surface, and wherein the flexible cage extends around the article of footwear to contact both a lateral and a medial side of the midsole and the upper.

10. The article of footwear of claim 9, wherein the wedge is disposed on a medial side of the footwear.

11. The article of footwear of claim 10, wherein the wedge is further disposed under a heel portion of the footwear.

12. The article of footwear of claim 11, wherein the wedge is solely disposed on a medial portion of the footwear.

13. The article of footwear of claim 9, wherein the wedge comprises a material that has a higher compressive strength than that of a material of the midsole.

14. The article of footwear of claim 9, wherein the flexible cage extends above the midsole and is attached to a portion of the article of footwear above the midsole.

15. The article of footwear of claim 9, wherein the flexible cage comprises thermoplastic polyurethane.

16. The article of footwear of claim 9, wherein the wedge comprises EVA foam.

17. The article of footwear of claim 9, wherein the midsole comprises a thermoplastic elastomer.

18. The article of footwear of claim 9, wherein the flexible cage comprises a plurality of apertures.

* * * * *